US005399857A

United States Patent [19]

Doroshenko et al.

[11] Patent Number: 5,399,857

[45] Date of Patent: Mar. 21, 1995

[54] METHOD AND APPARATUS FOR TRAPPING IONS BY INCREASING TRAPPING VOLTAGE DURING ION INTRODUCTION

[75] Inventors: Vladimir M. Doroshenko; Robert J. Cotter, both of Baltimore, Md.

[73] Assignee: The Johns Hopkins University, Baltimore, Md.

[21] Appl. No.: 68,697

[22] Filed: May 28, 1993

[51] Int. Cl.[6] ..... H01J 49/42

[52] U.S. Cl. ..... 250/292; 250/282; 250/291; 250/288

[58] Field of Search ..... 250/282, 291, 292, 283, 250/290, 286, 288 R

[56] References Cited

U.S. PATENT DOCUMENTS

| | | | |
|---|---|---|---|
| 2,939,952 | 6/1960 | Paul et al. . | |
| 3,527,939 | 9/1970 | Dawson et al. | 250/292 |
| 4,540,884 | 9/1985 | Stafford et al. | 250/282 |
| 4,650,999 | 3/1987 | Fies, Jr. et al. | 250/282 |
| 4,736,101 | 4/1988 | Syka et al. | 250/282 |
| 4,771,172 | 9/1988 | Weber-Grabau et al. | 250/292 |
| 5,075,547 | 12/1991 | Johnson et al. | 250/292 |

OTHER PUBLICATIONS

Raymond E. March & Richard J. Hughes, Quadrupole Storage Mass Spectrometry, John Wiley & Sons, NY, N.Y., 1989, pp. 451–456.

R. Graham Cooks, G. L. Glish, Scott A. McLuckey, Raymond E. Kaiser, Ion Trap Mass Spectrometry, C & EN, Mar. 25, 1991, pp. 26–41.

R. Kaiser, Jr., R. Cooks, G. Stafford, Jr., J. Syka, P. Hemberger, Operation of a Quadrupole Ion Trap Mass Spectrometer . . ., Inter. Journal of Mass Spectrometry and Ion Processes, 106 (1091), pp. 79–115.

J. Williams, K. Cox, K. Morand, R. Cooks, R. Julian, Jr., R. Kaiser, High Mass-Resolution Using A Quadrupole Ion . . ., the 39th ASMS Conf. on Mass Spectrometry and Allied Topics, pp. 1481–1482.

Raymond E. March, Ion Trap Mass Spectrometry, Inter. Journal of Mass Spectrometry and Ion Processes, 118/119 (1992) pp. 71–135.

D. N. Heller, I. Lys, R. J. Cotter, Laser Desorption from a Probe in the Cavity of a Quadrupole Ion Storage Mass Spectrometer, Analytical Chemistry, vol. 61, No. 10, May 15, 1989, pp. 1083–1086.

V. M. Doroshenko, T. J. Cornish, R. J. Cotter, Matrix--assisted Laser Desorption/Ionization inside a Quadrupole Ion-trap Dector Cell, Rapid Communications in Mass Spectrometry, vol. 6, (1992), pp. 753–757.

K. A. Cox, J. D. Williams, R. G. Cooks, Quadrupole Ion Trap mass Sectrometry: Current Applications and Future Directions for Peptide Analysis, Biological Mass Spectrometry, vol. 21, (1992), pp. 226–241.

D. M. Chambers, D. E. Goeringer, S. A. McLuckey, G. L. Glish, Matrix-Assisted Laser Desorption of Biological Molecules in the Quadrupole Ion Trap Mass Spectrometer, Anal. Chemistry, vol. 65, No. 1, Jan. 1, 1993, pp. 14–20.

(List continued on next page.)

*Primary Examiner*—Jack I. Berman
*Assistant Examiner*—James Beyer
*Attorney, Agent, or Firm*—Cushman, Darby & Cushman

[57] ABSTRACT

A method and apparatus for trapping ions in an ion trap having a ring electrode and a plurality of end-cap electrodes. Ions are introduced into a ion trap cavity of the ion trap from an external source or by desorption of a substance in the ion trap cavity. In a first embodiment, as the ions are introduced in the ion trap cavity, the amplitude of an RF voltage being applied to the ring electrode is gradually increased to trap the ions in the ion trap cavity. In a second embodiment, as the ions are introduced in the ion trap cavity, a retarding voltage is applied to the end-caps to reduce the initial kinetic energy of the ions. In a third embodiment, as the ions are introduced in the ion trap cavity from a probe tip inserted in the cavity, a retarding voltage is applied to the probe tip.

34 Claims, 14 Drawing Sheets

OTHER PUBLICATIONS

J. N. Louris, J. W. Amy, T. Y. Ridley, R. G. Cooks, Injection of Ions into a Quadrupole Ion Trap Mass Spectrometer, Inter. Journal of Mass Spectrometry and Ion Processes, vol. 88 (1989), pp. 97–111.

M. Nand Kishore, P. K. Ghosh, Trapping of Ions Injected from an External Source into a Three-Dimensional R.F. Quadrupole Field, Inter. Journal of Mass Spectrometry and Ion Physics, vol. 29, (1979), pp. 345–350.

J. F. J. Todd, D. A. Freer, R. M. Waldren, The Quadrupole Ion Store (Quistor). Part XII. The Trapping of Ions Injected . . . Dynamics, Inter. Journal of Mass Spect. and Ion Physics, vol. 36 (1980), pp. 371–386.

Chung-Sing O, Hans A. Schuessler, Confinement of Pulse-Injected External Ions in a Radiofrequency Quadrupole Ion Trap, Inernational Journal of Mass Spectrometry and Ion Physics, vol. 40 (1981), pp. 53–66.

Chun-Sing O, Hans A. Schuessler, Confinement of Ions Injected into a Radiofrequency Quadrupole Ion Trap: Pulsed Ion Beams of Different Energies, Inter. Journal of Mass Spectrometry and Ion Physics, vol. 40 (1981), pp. 67–75.

Chun-Sing O, Hans A. Schuessler , Confinement of Ions Injected into a Radiofrequency Quadrupole Ion Trap: Energy-Selective Storage of Pulse-Injected Ions, Inter. Journal of Mass Spect. and Ion Physics, vol. 40 (1981) pp. 77–86.

S. M. Sadat Kiai, J. Andre, Y. Zerega, G. Brincourt, R. Catella, Study of a Quadrupole Ion Trap Supplied with a Periodic Impulsional Potential, International Journal of Mass Spect. & Ion Processes, vol. 107 (1991) pp. 191–203.

G. J. Van Berkel, G. L. Glish, S. A. McLuckey, Electrospray Ionization Combined with Ion Trap Mass Spectrometry, Analytical Chemistry, vol. 62, No. 13, Jul. 1, 1990, pp. 1284–1295.

A. McIntosh, T. Donovan, J. Brodbelt, Axial Introduction of Laser-Desorbed Ions into a Quadrupole Ion Trap Mass Spectrometer, The 40th ASMS Conference on Mass Spectrometry and Allied Topics, pp. 1755–1756.

R. C. Beavis, B. T. Chait, Velocity Distributions of Intact High Mass Polypeptide Molecule Ions Produced by Matrix Assisted Laser Desorption, Chemical Physics Letters, vol. 181, No. 5, Jul. 5, 1991, pp. 479–484.

METHOD AND APPARATUS FOR TRAPPING IONS BY INCREASING TRAPPING VOLTAGE DURING ION INTRODUCTION

BACKGROUND OF THE INVENTION

1. Field of the Invention

The invention relates to an apparatus and method for trapping ions, in particular, a quadruple ion storage trap and method therefor.

2. Description of Related Art

Quadruple ion traps are characteristic of a family of instruments which includes a variety of mass spectrometers and mass filters. These types of instruments are used for mass analyzing and detecting electrically charged particles (ions) formed from atoms or molecules by extraction or attachment of electrons, protons or other charged species.

Ions, rather than neutral molecules, are analyzed because their motion is readily controllable in the gas phase using electric and magnetic fields. The main parameter which is used in these instruments for analyzing and separating the ions is the ratio of the mass of an ion to its charge (m/z). The mass (m) is usually expressed in atomic mass units (1 amu − 1/12 of the mass of a carbon atom) and charge (z) is the number of charges of electron.

Ion traps are devices capable of storing one or more kinds of ions for long periods of time (from milliseconds to hours). This allows one to accumulate ions and study their properties and/or chemical reactions, in some cases, for example, by using external probes.

Ion traps also may be utilized as instruments for mass analyzing and detecting ions, and tandem experiments. When employing an ion trap, tandem experiments may be carried out in a single instrument, where successive reaction steps are separated in time, rather than space. Given the recognized success of conventional tandem instruments in structural biological research, this suggests broad opportunities for utilizing ion traps in biochemistry, protein chemistry and molecular biology to analyze the structures and sequences of biomolecules. Further, the ion storage capability of the ion trap allows one to carry out multiple fragmentation steps, and therefore has the potential for extending tandem (MS/MS) experiments to MS/MS/MS and beyond.

Conventionally, the second and third quadruple instruments that are commonly used for tandem experiments employ additional mass analyzers, resulting in a concomitant increase in expense. However, additional mass analyzers are not needed when a quadruple ion trap is employed.

The conventional quadruple ion trap was invented in the late 1950s by Wolfgang Paul from the University of Bonn (Paul, W.; Steinwedel, H.; German Patent 944,900,1956; U.S. Pat. No. 2,939,952, 7 Jun. 1960). Finnigan Corporation (Sunnyvale, Calif.) produced a commercial version of the quadruple ion trap known as the ion trap detector (ITD) which was used primarily as a low cost mass selective detector for gas chromatography.

The quadruple ion trap (ion trap) uses only time-varying electric field to trap ions and comprises a central, hyperbolic cross-section ring electrode positioned between two hyperbolic end-cap electrodes. This design and related operating characteristics of the Finnigan ion trap are shown schematically in FIGS. 1A and 1B. The RF electrode in FIG. 1A has rotational symmetry about a vertical axis.

Ions can be formed by variety of methods. In the Finnigan ion trap, ionization is performed by electron impact (EI). The ions are trapped and confined inside the ion trap cell by applying a radiofrequency (RF, usually approximately 1 MHz) voltage on the ring electrode with the end-cap electrodes being grounded. The time-varying quadruple electric field created in this configuration exerts forces on the ions which cause the ions to undergo vibrational motion about the center of the trap and then become "trapped" in the ion trap.

Ions of different m/z ratio can be trapped simultaneously. The mass range of ions that are trapped can be determined by the ion stability diagram and related equations shown in FIG. 2, using dimensionless parameters ($a_z$ and $q_z$) that depend upon the radius of the trap (r), the DC (U) and RF (V) voltage amplitudes, and the RF frequency (w). The regions of stable motion in the vertical (z) direction (dark color) and in the plane of the ring electrode (grey color) are shown. The intersection of these two regions corresponds to stable trajectories in both directions. Ions not within this region collide with the walls of the trap and are lost due to neutralization.

By changing the operating parameters of the trap (i.e. U, V, or w) appropriately, it is possible to cause the ions to exit the trap in an order based on their mass/charge ratio. In this way, the ion trap can be utilized as a mass spectrometer to measure the molecular weights of the ions.

The most popular operational mode of an ion trap is the mass selective instability mode. In this mode, ions move along the $q_z$ axis (U=0) from the left to right side of the stability diagram with increasing RF voltage amplitude (V). Ions of increasingly higher mass arrive at the stability border in succession, exit the trap in the z direction and are detected by a multiplier located behind one of the end-caps (see e.g., FIG. 1A).

An important feature of a conventional ion trap is the presence of helium buffer gas within the trap at a relatively high (approximately 1 mtorr) pressure. A major function of the helium buffer gas is to decrease the ion kinetic energies through collisions, and to dampen the amplitude of ion motion thereby causing the ions to fall towards the center of the trap and remain there for a period of time. The stored ions can be expelled to the electron multiplier detector through a small perforation in the central part of the bottom end-cap electrode. The buffer gas also increases the mass resolution of the device when the scan speed is high. Alternatively, when lower scan speeds are used to increase mass resolution, the optimum pressure of the buffer gas also is lowered.

Finnigan later produced a more advanced version of the ion trap called the ion trap mass spectrometer (ITMS). The geometry of the ITMS was no different from that of the ion trap detector, but contained additional electronics, software, and the ability to provide supplementary RF voltages on the end caps, which were no longer grounded (see FIG. 3). This enabled one to control ion motion in the z direction via software control that was used for the more complex scan modes employed to perform MS/MS, etc. type experiments.

In recent years, considerable progress has been made in the development of the quadruple ion trap, primarily in mass range and resolution. The mass range has now been shown to exceed 70,000 daltons (Kaiser, R. E., Jr.; Cooks, R. G.; Stafford, G. C., Jr.; Syka, J. E. P.; Hemberger, P. H. Int. J. Mass Spectrom. Ion Processes, 106 (1991) 79). Mass resolution exceeding one part in $10^6$ has also been achieved (Williams, J. D.; Cox, K.; Morand, K. L.; Cooks, R. G.; Julian, R. K.; Kaiser, R. G. in Proceedings of the 39th ASMS Conference on Mass Spectrometry and Allied Topics, Nashville, Tenn., 1991, p. 1481). These achievements have become possible using the axial resonant ejection mode of operation and scan speeds slowed by a factor of 333 in comparison with those used in normal operation.

Axial excitation was first described in a patent (Syka, J. E. P.,; Louris, J. N.; Kelley, P. E.; Stafford, G. C.; Reynolds, W. E.; U.S. Pat. No. 4,736,101, 5 Apr. 1988) for a method intended to provide enhanced mass resolution. In this method, a bipolar, supplementary, low amplitude RF voltage is applied to the end-cap electrodes (see, for example, FIG. 3). The dipole electric field strongly affects the motion of ions of a particular mass/charge if the frequency of this field is in resonance with the frequency of their oscillation in z direction.

If the amplitude and duration of the supplementary RF excitation are small, then the ions exhibit an increase in their amplitude of oscillation, but continue to have stable trajectories. As the amplitude or duration of the excitation increases further, ions in resonance will exit the trap in the z-direction and be detected by the detector.

The resonant frequency depends upon the amplitude of the trapping RF field. One may obtain a mass spectrum by scanning the amplitude of the RF voltage applied to the ring electrode after the ions are trapped (see, for example, the RF voltage graph in FIG. 1B). Thus, the axial excitation scanning process is similar to that used for the mass selective instability mode of operation. However, in this case, ions can be ejected at any point along the $q_z$ axis lying within the stability diagram (see FIG. 2), while in the mass selective instability mode, they exit the trap along the extreme right point along the $q_z$ axis where it intersects the boundary of stability region (see FIG. 2). Thus, any mass may be ejected by the axial excitation method using an appropriate choice of the frequency of the exciting voltage.

During the past three years, considerable progress has been made in performing $(MS)^n$ type experiments with the use of ion traps, with $n>8$ achieved successfully. These achievements have been reviewed (March, R. E. Int. J. Mass Spectrom. Ion Processes, 118/119 (1992) 71), and have stimulated investigators in a number of fields to utilize this versatile ion trap instrument in their research. However, a major problem has been the ability to use the ion trap with ionization techniques that are capable of ionizing the large biomolecules (with molecular weights up to $10^6$ daltons) that are of interest to biochemists and molecular biologists.

Approaches for interacting ionization techniques with the ion trap can be divided between those which form ions directly inside the ion trap cell, and those which form ions in an external source and subsequently introduce the ions into the trap. A third method, developed in Johns Hopkins' laboratory (Heller, D. N.; Lys, I.; Cotter, R. J.; Uy, O. M., Anal. Chem., 61 (1989) 1083), involves forming ions on the inside surfaces of the trap. However, these ions may be considered to be formed by an external source because, in this method, it is necessary to overcome the same potential barrier for introducing and trapping ions in the center of the cell that exists for ions formed externally. That is, ions with low kinetic energies do not penetrate the potential barrier, while ions with higher kinetic energies will penetrate the potential barrier but not be trapped.

The most common example of internal ion production is the EI method used in the ion trap device developed as a mass selective detector for gas chromatography discussed previously. In the EI method, because the ions are formed in the gas phase in the center of the ion trap, the problems associated with introducing ions into the center of the trapping field does not exist. EI is one of the oldest ionization methods used in mass spectrometry, but it is not suitable for most modern applications because it requires that the neutral molecules to be ionized be volatile and thermally stable, and in addition causes excessive fragmentation.

For larger, non-volatile biomolecules, other ion forming methods have been developed and are known generally as desorption/ionization (DI) methods. Unfortunately, these ionization methods must be performed outside the trapping field. In these methods, ions are formed from surfaces which cannot be inserted directly into the electrostatic field because those surfaces would interfere with the field and the ion motion.

Desorption methods are utilized primarily for large molecules. The following desorption methods have been used with ion traps: secondary ion mass spectrometry (SIMS) in which secondary (sample) ions are desorbed from surfaces by a high energy beam of primary ions; fast-atom bombardment (FAB) where the primary particles are high energy neutral species; electrospray ionization (ESI) in which ions are evaporated from solutions; and laser desorption (LD) which utilizes a pulsed laser beam as the primary energy source.

Several years ago, a variation on laser desorption known as matrix-assisted laser desorption/ionization (MALDI) was developed. This method also has been used with ion traps. In that method, the biomolecules to be analyzed are recrystallized in a solid matrix of a low mass chromophore. Following absorption of the laser radiation by the matrix, ionization of the analyte molecules occurs as a result of desorption and subsequent charge exchange processes.

The ESI and MALDI methods have been the most prominent recently because they have been shown to be able to desorb intact molecular ions of proteins with molecular weights in excess of 100 kdaltons. Because the MALDI was the most recent method to be used with the ion trap, few reports describing that method exist (Doroshenko, V. M.; Cornish, T. J.; Cotter, R. J. Rapid Commun. Mass Spectrom., 6 (1992) 226) (Cox, K. A.; Williams, J. D.; Cooks, R. G.; Kaiser, R. E., Jr. Biological Mass Spectrom., 21 (1992) 226) (Chambers, D. M.; Goeringer, D. E.; McLuckey, S. A.; Glish, G. L. Anal. Chem., 65 (1993) 14–20).

As shown diagrammatically in FIG. 4, ions formed external to the ion trap may be introduced into the trapping field through a hole in the ring electrode or a hole in one of the end-caps, or through the space between the electrodes. As discussed previously, a major problem is that the ion kinetic energy needed to overcome the RF field also prevents trapping of the ions. There are two major approaches to overcoming this problem.

The first approach (Louris, J. N.; Amy, J. W.; Ridley, T. Y.; Cooks, R. G. Int. J. Mass Spectrum. Ion Processes, 88 (1989) 97) is to accelerate the ions to kinetic energies sufficient to overcome the potential barrier and introduce them into the active RF field, and subsequently reduce their kinetic energies through collisions with a buffer gas (helium). Since the amplitude of the RF field is constant during ion introduction, this method is most suitable for the continuous methods of ionization (SIMS, FAB, and ESI) where it has been actually applied. At the same time, this method has also been used in pulsed LD and MALDI configurations.

In general, this method is characterized by high pressures of buffer gas (more than $10^{-3}$ torr) and relatively low trapping efficiency, which is compensated by longer ion accumulation times when continuous ionization is utilized. Trapping efficiency decreases with the lower pressures required to achieve high mass resolution, and is inherently low for pulsed methods of ionization. These are main disadvantages associated with a method which carries out ion trapping in an active RF field.

The second approach involves gating the RF field synchronously with the introduction of ions into the trap. This was the subject of a patent (Dawson, P. H.; Whetten, N. R. U.S. Pat. No. 3,521,939; 1970), and described theoretically but never realized practically. (Kishore, M. N.; Ghosh, P. K. Int. J. Mass Spectrom. Ion Physics, 29 (1979) 345); (Todd, J. F. J.; Freer, D. A.; Waldren, R. M. Int. J. Mass Spectrom. Ion Physics, 36 (1980) 371); (O, C.-S.; Schuessler, H. A. Int. J. Mass Spectrom. Ion Physics, 40 (1981) 53); (O, C.-S.; Schuessler, H. A. Int. J. Mass Spectrom. Ion Physics, 40 (1981) 67); (O, C.-S.; Schuessler, H. A. Int. J. Mass Spectrom. Ion Physics, 40 (1981) 77).

In that approach, the RF field is off prior to introduction of the ions into the trap, and is turned on abruptly as the ions reach the center of the trap. Theoretical calculations suggested a relatively high efficiency for ion capture if the ion kinetic energy and the RF voltage amplitude are properly matched. A major problem with this method is that phase-synchronized switching of the RF amplitude demands that RF voltages of several kilovolts are turned on with a phase accuracy of at least 100 ns (for an RF frequency of 1 MHz). This dilemma has been the major obstacle to its implementation.

Another approach has been described in a publication (Sadat Kiai, S. M.; Andre, J.; Zerega, Y.; Brincourt, G.; Catella, R. Int. J. Mass Spectrom. Ion Processes, 107 (1991) 191). In that method, in place of the normal RF potential, $V_0 \cos wt$, a periodic impulse potential of the form $V_0 \cos wt/(1-k \cos 2wt)$ where $0 \lesssim k \lesssim 1$, was shown to be capable of trapping injected ions resulting from the presence of time-dependent zero potential zones.

Configurations for injecting ions from outside the ion trap differ somewhat from those used to desorb ions formed inside the trap near the electrode surface (as described by Heller et al. using infrared laser desorption). Typical designs for the first approach are shown in FIG. 5 for ESI at atmospheric pressure (Van Berkel, G. J.; Glish, G. L.; McLuckey, S. A. Anal. Chem., 62 (1990) 1284), and in FIG. 6 for LD ionization outside the ion trap (Mcintosh, A.; Donovan, T.; Brodbelt, J. in Proceedings of the 40th ASMS Conference on Mass Spectrometry and Allied Topics, May 31–Jun. 5, 1992, p. 1755).

As shown in FIG. 5, electrostatic lenses are used to focus the ion beam through the small centered hole in one of the end-caps. As shown in FIG. 6, the ions are formed near holes in the end-caps by laser radiation supplied through a fiber optic guide. No additional electrostatic optics were used in that method.

FIG. 7 shows the configuration used for forming ions at the inside surface of the ring electrode (see Heller, D. N.; Lys, I.; Cotter, R. J.; Uy, O. M. Anal. Chem., 61 (1989) 1083). In this system, two holes are drilled in the ring electrode to enable the sample probe and laser beam to be introduced at opposite directions.

Graphical representations of RF voltages applied to the ring electrode in prior methods for ion trapping are shown in FIGS. 8A and 8B. FIGS. 8A and 8B show an active continuous RF field and a synchronized switching RF field, respectively, that can be applied to the ring electrode. For a pulsed laser ionization source, some form of gating of the RF voltage is preferable. However, phase-synchronized, rapid switching of the RF high voltage (FIG. 8B) simultaneously with laser pulse is difficult to achieve and has been theoretically modeled but not implemented.

As known in conventional systems, several kilovolts are usually applied to the ring electrode to trap ions having energies of about 10 eV. Also, in the MALDI method, it has been shown that ions of different mass all have approximately the same velocities, so that their kinetic energies increase proportionally with the mass (Beavis, R. C.; Chait, B. T. Chem. Phys. Lett., 181 (1991) 497). Thus, high mass ions may have kinetic energies of 100 eV or more, requiring that an unrealistically high RF voltage be applied to the ring electrode to trap them in the ion trap.

SUMMARY OF THE INVENTION

An object of this invention is to provide an apparatus and method to allow interfacing of matrix-assisted laser desorption/ionization (MALDI) with an ion trap mass spectrometer (ITMS) while obviating problems associated with conventional apparatuses. The MALDI technique allows ionization of large biological molecules, including peptides, proteins and oligonucleotides. However, the ions produced by this method have considerably high initial kinetic energies. The ITMS is a quadruple ion storage trap that is utilized as a mass spectrometer and has been developed for mass analysis of large biological molecules and for tandem mass spectral measurements. The ITMS most efficiently traps and stores ions formed with low kinetic energies within the quadruple field.

To achieve the above object, Doroshenko et al. have employed phase synchronization techniques to improve trapping efficiency while using the MALDI method (Doroshenko, V. M.; Cornish, T. J.; Cotter, R. J. Rapid Commun. Mass Spectrom., 6 (1992) 226). The present invention provides a method and apparatus for trapping ions with high kinetic energies, formed outside the quadruple ion trapping field either on or in the vicinity of the ion trap electrodes, or outside the physical confines of the apparatus itself.

In a first embodiment of the invention, the apparatus comprises two end cap electrodes and a ring electrode. A substance is introduced into the apparatus by a probe or the like.

A light beam such as a laser beam or the like is directed at the substance on the probe to cause ions to be generated from the substance and thus be introduced in the apparatus. A gradually increasing alternating voltage is applied to the ring electrode beginning at a time when the ions are being introduced into the trap (as shown in FIG. 8C). As the ions are introduced (i.e. formed) into the apparatus, the increased voltage being applied to the ring electrode creates an ion trapping field which traps the ions in the apparatus.

Because the amplitude of the RF voltage is initially low, to enter the trapping field, the ions can have a low initial kinetic energy. That is, unlike the method shown in FIG. 8A wherein the RF voltage is constant, in the present invention, the ions need not have an initial kinetic energy high enough to overcome a high potential barrier created by a constant amplitude RF voltage.

The first embodiment can be used with various arrangements for decreasing the initial kinetic energy of ions being introduced in the trap. For example, in a second embodiment of the invention, during the time that the ions are being introduced into the ion trap, a DC voltage is applied to at least one of the end caps to reduce the initial kinetic energy of the ions. A gradually increasing alternating voltage is applied to the ring electrode as in the first embodiment when the ions are being introduced into the trap.

In the second embodiment, when the ions are trapped in the ion trapping field, the end cap voltage is removed from the end cap electrodes and a second voltage (RF or the like) is applied to the end cap electrodes. This second voltage can be adjusted to cause ions of a particular molecular weight trapped in the ion trapping field to oscillate and exit the ion trapping field. That is, as the second voltage is varied, ions of varying molecular weights trapped in the ion trapping field are expelled from the ion trapping field. Also, if desirable, such second voltage can be applied to the end caps of the first embodiment after the ions are trapped in the ion trapping field and varied as described above.

The ions exiting the ion trapping field can exit the apparatus, for example, through a small opening in one of the end cap electrodes. A detector such as a electron multiplier detector or the like detects the ions exiting the apparatus and outputs signals from which parameters of the ions can be determined.

In a third embodiment of the invention, the apparatus comprises a plurality of end cap electrodes and a ring electrode. A substance is introduced into the apparatus by a probe or the like.

A light beam such as a laser beam or the like is directed at the substance on the probe to cause ions to be generated from the substance and thus introduced in the apparatus. While the ions are being introduced into the apparatus, a DC voltage is applied to the probe to reduce the initial kinetic energy of the ions and the end caps are, for example, grounded, or set at a voltage potential different than that applied to the probe.

As in the first and second embodiments, a gradually increasing alternating RF voltage is applied to the ring electrode as the ions are being introduced in the apparatus. As the ions are introduced into the apparatus, the voltage being applied to the ring electrode creates an ion trapping field which traps the ions in the apparatus.

Also, as in the second embodiment, when the ions are trapped in the ion trapping field, a second voltage (RF or the like) is applied to the end cap electrodes in place of ground or the initial end cap voltage applied to the end caps. This second voltage can be adjusted to cause ions of a particular molecular weight trapped in the ion trapping field to oscillate, exit the ion trapping field and be detected as described above in the second embodiment.

The method and apparatus are extendable to other methods of ionization, including direct laser desorption (LD), fast atom bombardment (FAB), secondary ionization mass spectrometry (SIMS), electrospray ionization, or any other method that produces ions with greater than thermal initial kinetic energies and/or for any experiment requiring that ions be formed external to the center of the quadruple field.

BRIEF DESCRIPTION OF THE DRAWINGS

These and other objects and advantages of the invention will become more apparent and more readily appreciated from the following detailed description of the presently preferred exemplary embodiments of the invention taken in conjunction with the accompanying drawings, of which.

DETAILED DESCRIPTION OF THE PREFERRED EMBODIMENTS

The present invention provides a method and apparatus for trapping ions introduced into the trapping field of an ion trap such as a quadruple ion storage trap or the like. In the present invention, ions can be formed inside the ion trap. For example, an embodiment of the present invention was implemented on a modified ion trap detector in which ions were desorbed (using a pulsed Nd:YAG laser) from a probe inserted in the upper end-cap electrode. However, an alternative embodiment of the present invention also can be employed with an ion trap in which ions are injected through the end-caps from a source or sources external to the ion trap.

Figure 9A:
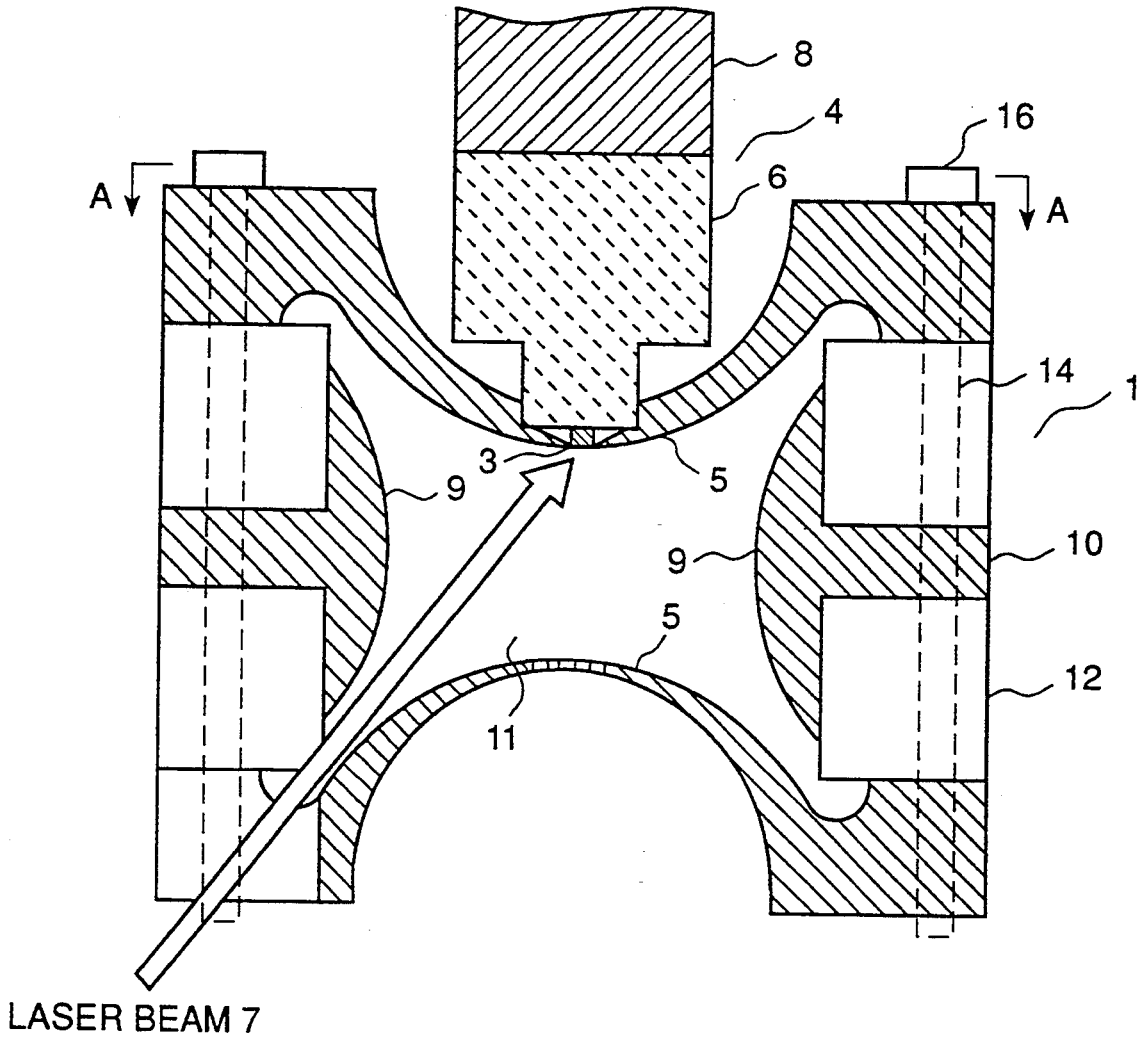
FIG. 9A is a diagrammatic cross-sectional view of the present invention showing ions generated in the ion trap.

FIG. 9A is a diagrammatic illustration of a cross-sectional view of an embodiment of an ion trap 1 employed by the present invention. The ion trap 1 is cylindrical and is similar in size to a coffee cup. That is, the ion trap 1 has an outer diameter of approximately 3 inches and a height of approximately 4 inches.

During operation, the ion trap 1 is disposed in a vacuum chamber (not shown). A probe tip 3 is inserted into a small hole in the upper end-cap electrode 5 of the ion trap 1. The end-cap electrodes 5 are substantially disk-shaped and each have a central convex portion protruding therefrom. The end-cap electrodes 5 are made of stainless steel or a like conductive material.

The probe tip 3 is made of stainless steel but also can be made of a like conductive material. Further, as shown in FIG. 9A, the probe 4 comprises a teflon portion 6 which insulates that probe tip 3 from the probe body 8.

The ring electrode 9 is made of stainless steel or the like similar to end-cap electrodes 5. As shown in FIG. 9A, the ring electrode 9 is substantially doughnut-shaped and flat about its outer circumference and has a thickness of about ⅛ inch as measured between its outer (flat) and inner (parabolic) circumference. A lip 10 is integral with and extends along the outer circumference of the ring electrode 9. Washer-shaped teflon spacers 12 separate the end-cap electrodes 5 from the ring-electrode 9 and provide insulation therebetween.

Figure 9B:
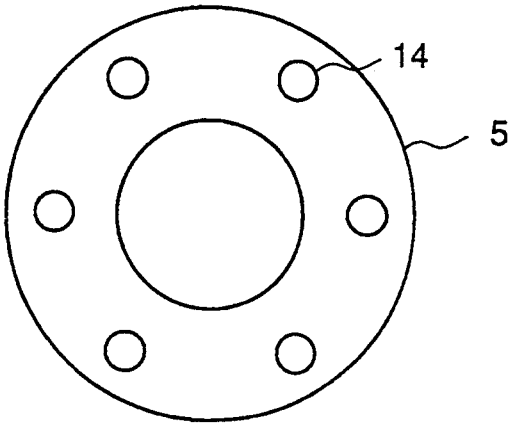
FIG. 9B is a perspective view taken along lines A—A in FIG. 9A.

As shown in FIGS. 9A and 9B, the end-cap electrodes 5, ring electrode 9 and teflon spacers 12 have a plurality (e.g. six) of substantially equally spaced holes 14 therein. These holes enable bolts 16 to pass through the end-cap electrodes 5, ring electrode 9 and teflon spacers 12. Nuts (not shown) can be screwed on the ends of the bolts 16 to hold the ion trap 1 together or alternatively, the bolts 16 can screw into holes in a surface of the vacuum chamber.

The bolts 16 can be made of non-conductive material such as teflon or the like or, alternatively, if the bolts 16 are made of conductive material, insulators (not shown) can be inserted in the holes 14 of the end-cap electrodes 5 and lip 10 of the ring electrode 9 to prevent electrical contact between the ring electrode 9 and the end-cap electrodes 5.

Sample molecules (not shown) disposed on the probe tip 3 of probe 4 are ionized inside the ion trap 1 near the upper end-cap electrode 5 during desorption by a pulsed laser beam 7 delivered through a gap in a teflon spacer 12 between the ring electrode 9 and end-cap electrode 5.

When ions are desorbed inside the ion trap 1 as shown in FIG. 9A, more ions reach the center of the trapping field in comparison with methods in which ion formation occurs external to the ion trap 1. Also, this embodiment of the present invention eliminates the need for providing additional holes in the end cap electrodes 5 on ring electrode 9 that might compromise the shape of the quadruple field during ion trap operation thereby resulting in unpredictable changes in ion motion and instability.

Figure 1A:
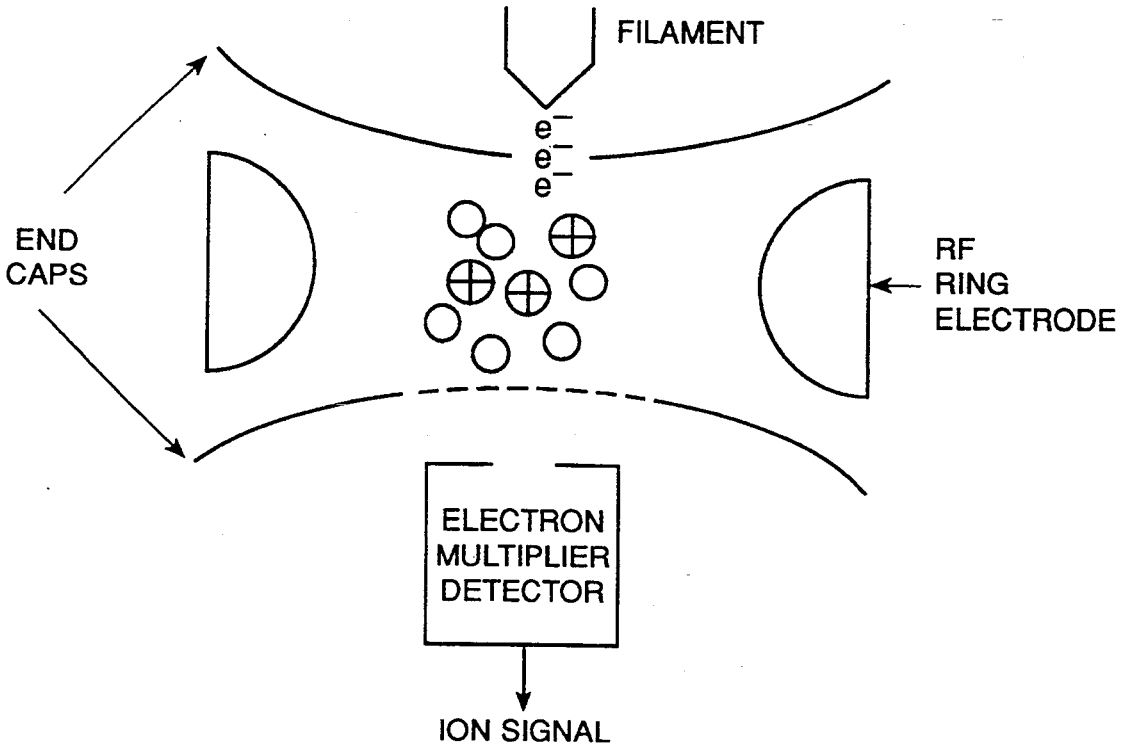
Fig. 1A (PRIOR ART)
FIG. 1A is a diagrammatic illustration of a conventional quadruple ion trap.
Figure 1B:
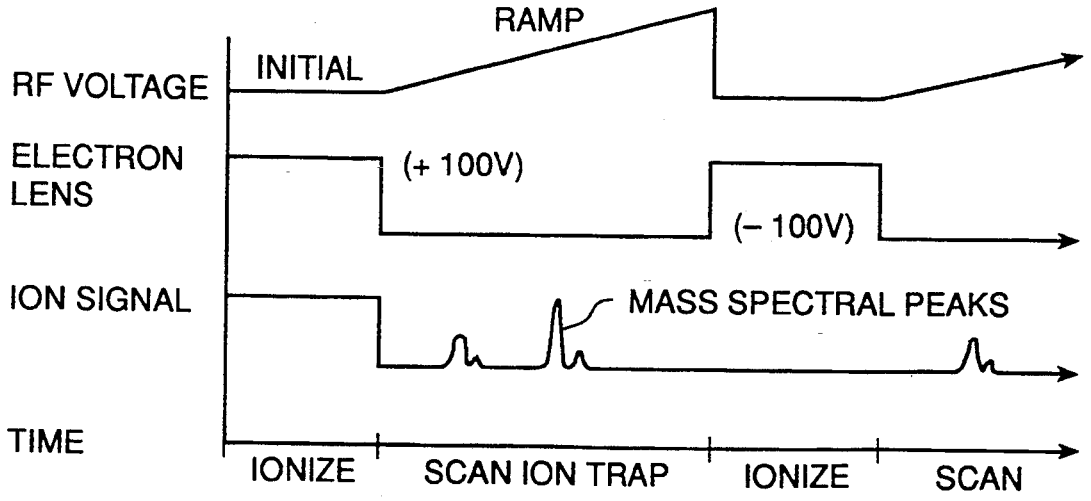
Fig. 1B (PRIOR ART)
FIG. 1B is a graphical representation of operating parameters of the conventional quadruple ion trap shown in FIG. 1.
Figure 2:
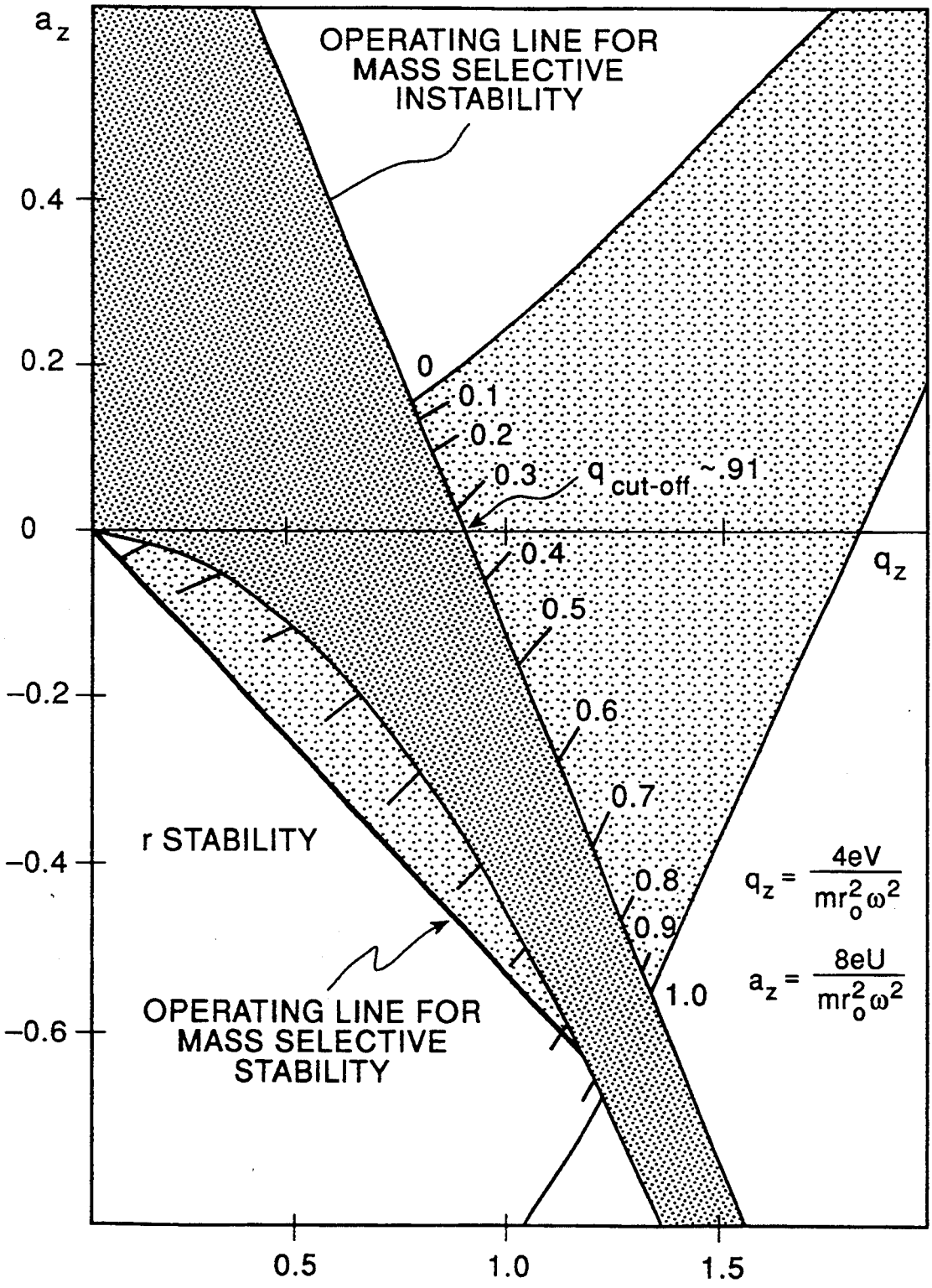
Fig. 2 (PRIOR ART)
FIG. 2 is a stability diagram for the conventional quadruple ion trap shown in FIG. 1.
Figure 3:
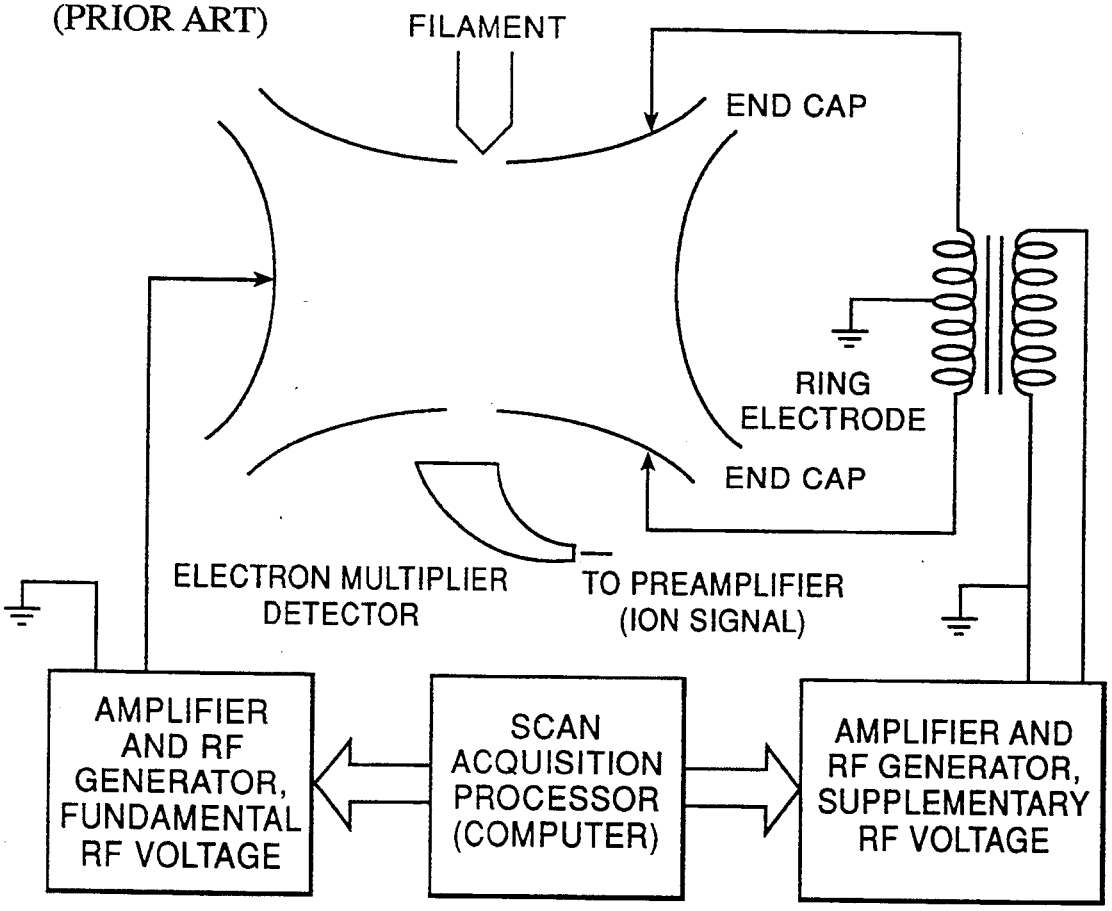
Fig. 3 (PRIOR ART)
FIG. 3 is a diagrammatic illustration of a conventional quadruple ion trap having a RF voltage applied to the end caps thereof.
Figure 4:
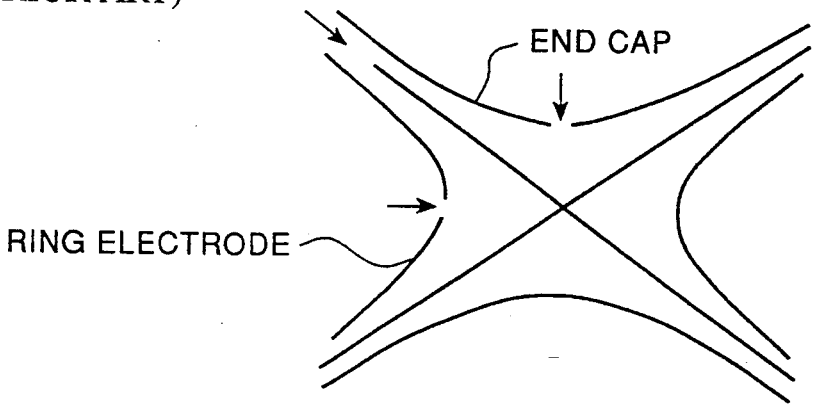
Fig. 4 (PRIOR ART)
FIG. 4 is a diagram showing various permutations in which ions can be introduced into a quadruple ion trap.
Figure 5:
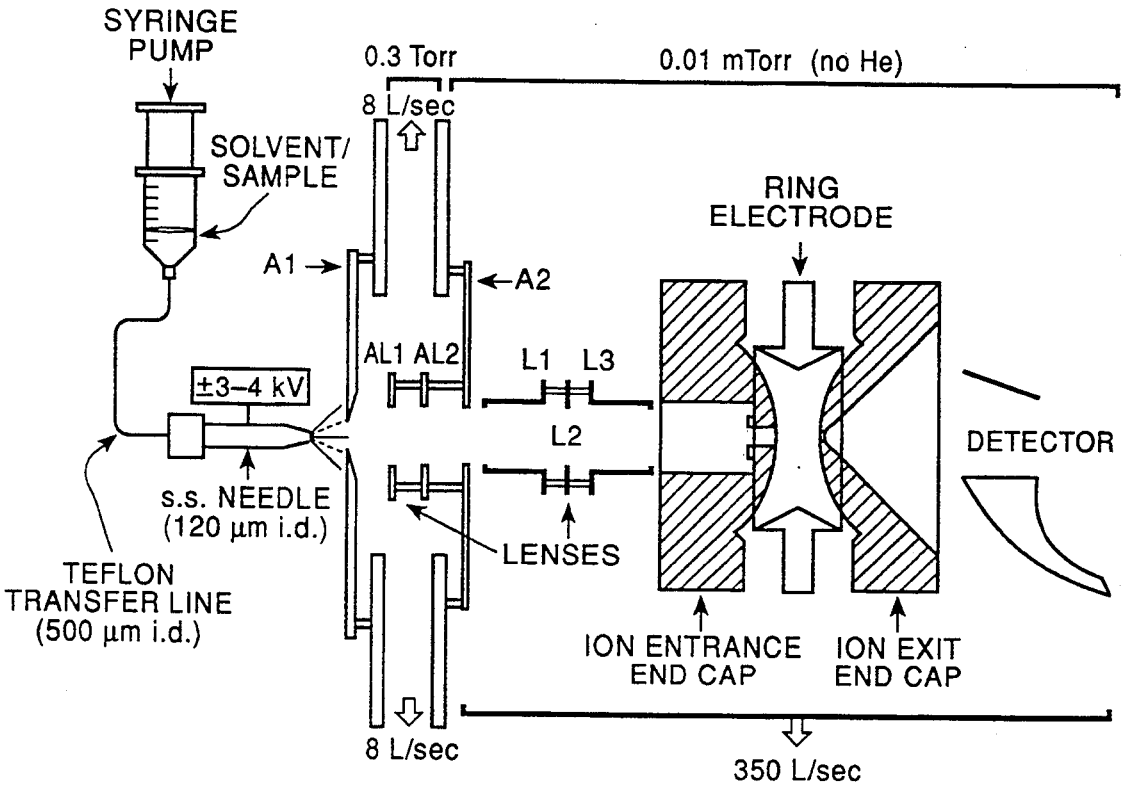
Fig. 5 (PRIOR ART)
FIG. 5 shows an arrangement using electrostatic lenses to introduce ions generated outside of the quadruple ion trap into the quadruple ion trap.
Figure 6:
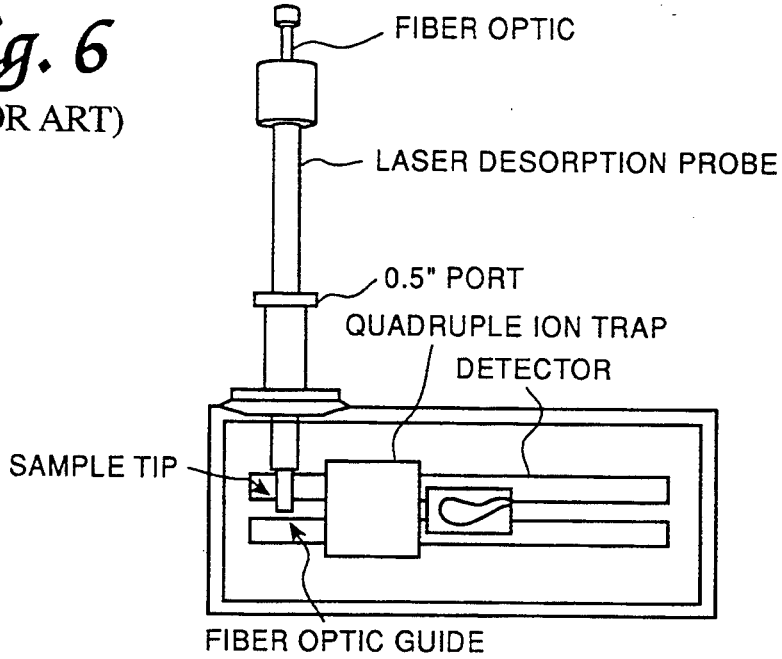
Fig. 6 (PRIOR ART)
FIG. 6 shows an arrangement using a fiber optic guide to introduce ions generated outside of the quadruple ion trap into the quadruple ion trap.
Figure 7:
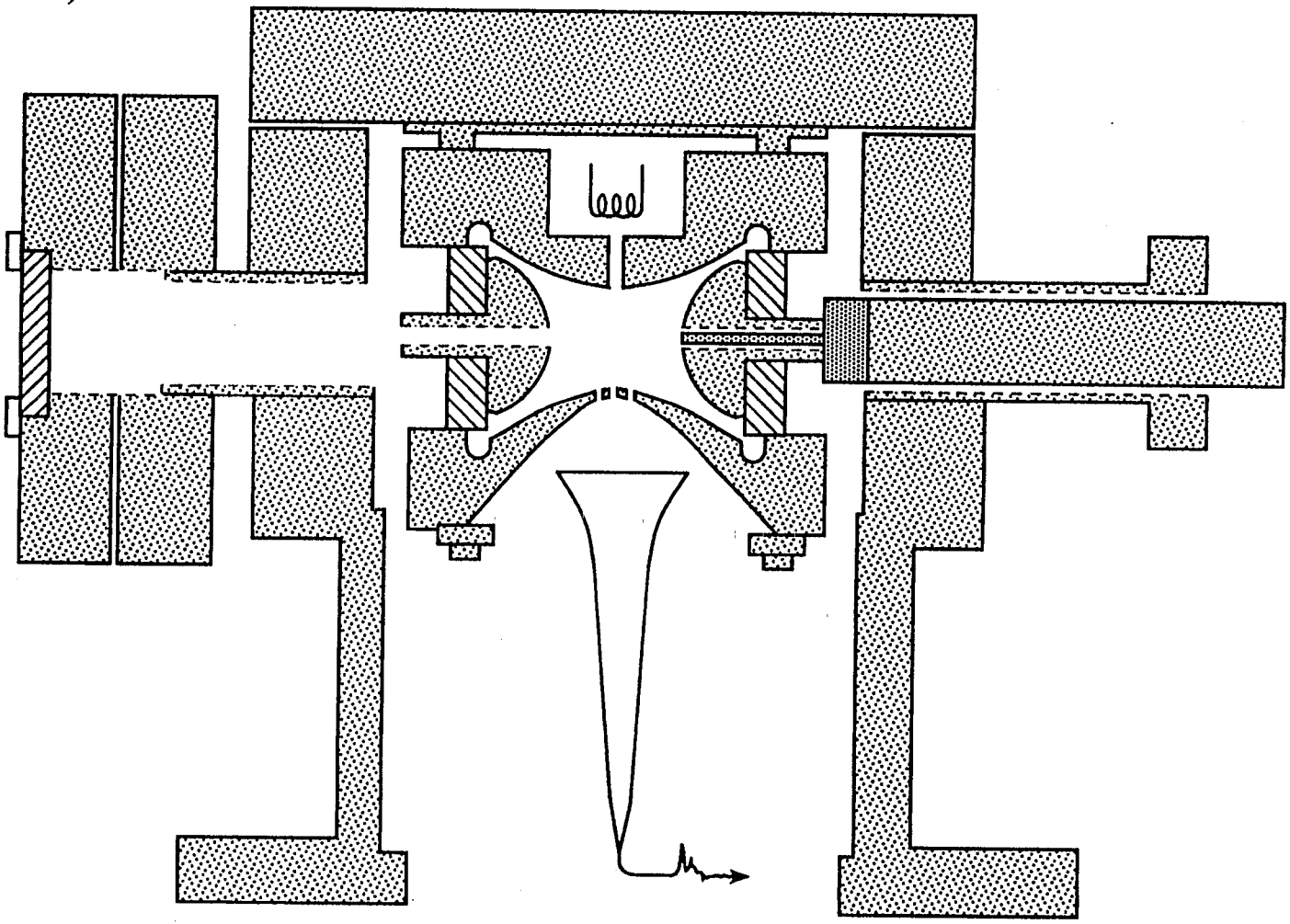
Fig. 7 (PRIOR ART)
FIG. 7 illustrates an arrangement for generating ions at the inside surface of the ring electrode of the quadruple ion trap.
Figure 8A:
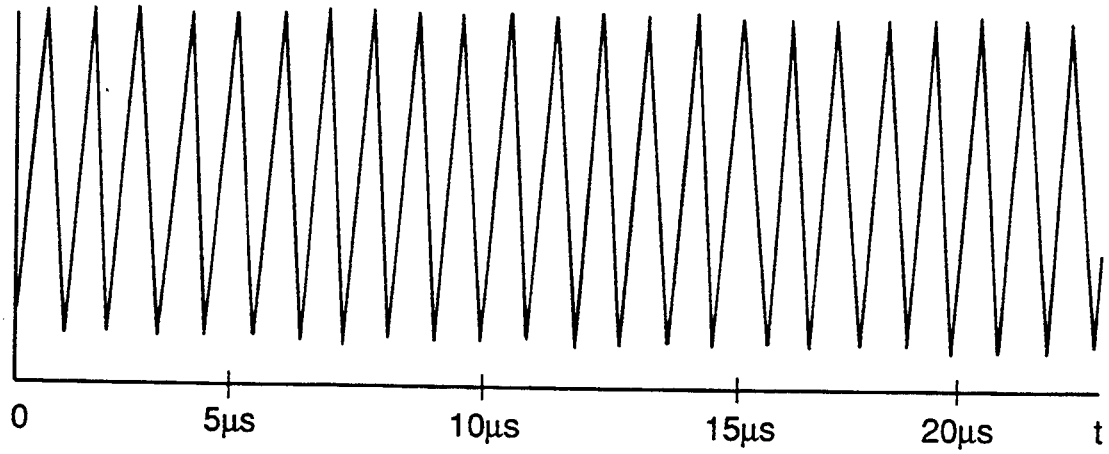
Fig. 8A (PRIOR ART)
FIGS. 8A and 8B are graphs of a conventional voltage and hypothetical voltage, respectively, that can be applied to the ring electrode of an ion trap.
Figure 8B:
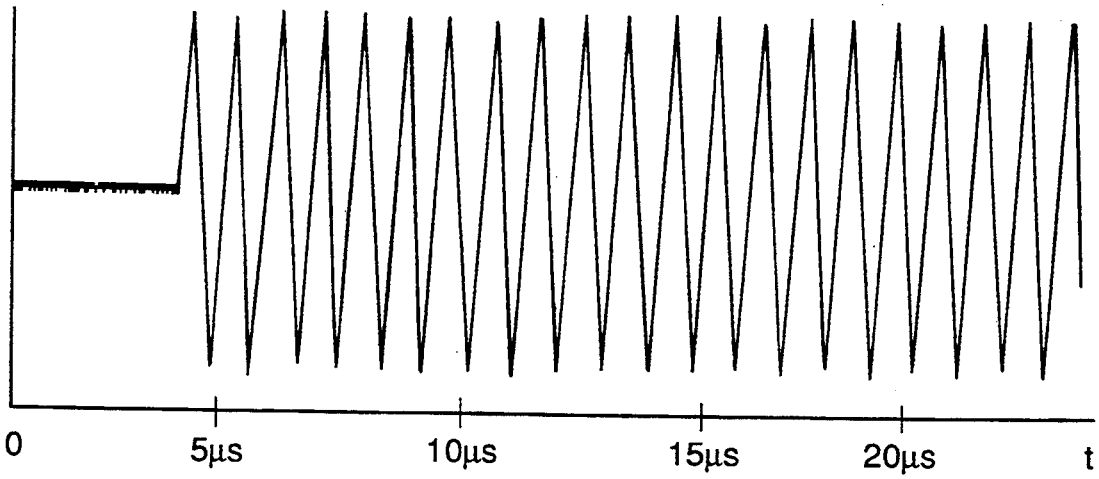
Fig. 8B (PRIOR ART)
Figure 8C:
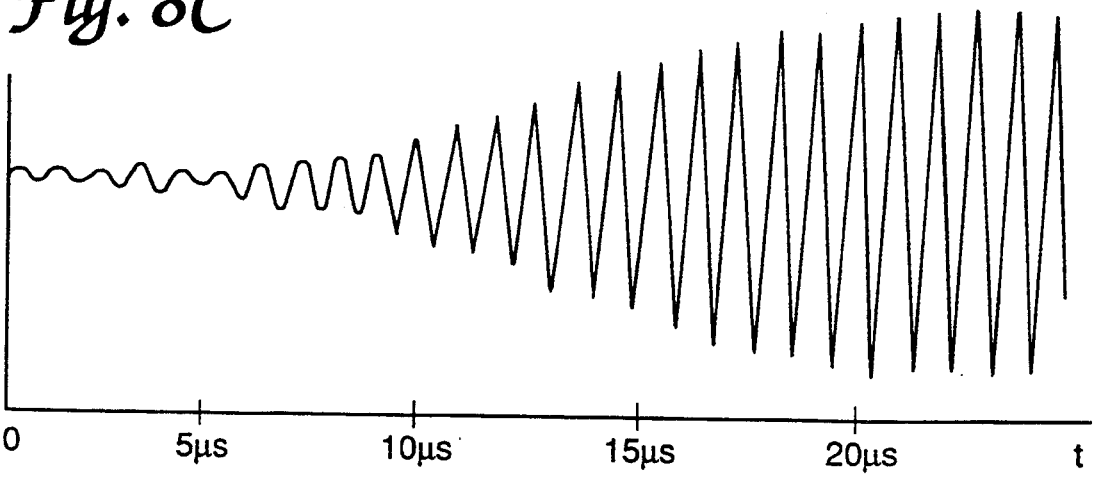
FIG. 8C is a graph of a voltage applied to the ring electrode of the ion trap in the present invention.
Figure 10A:
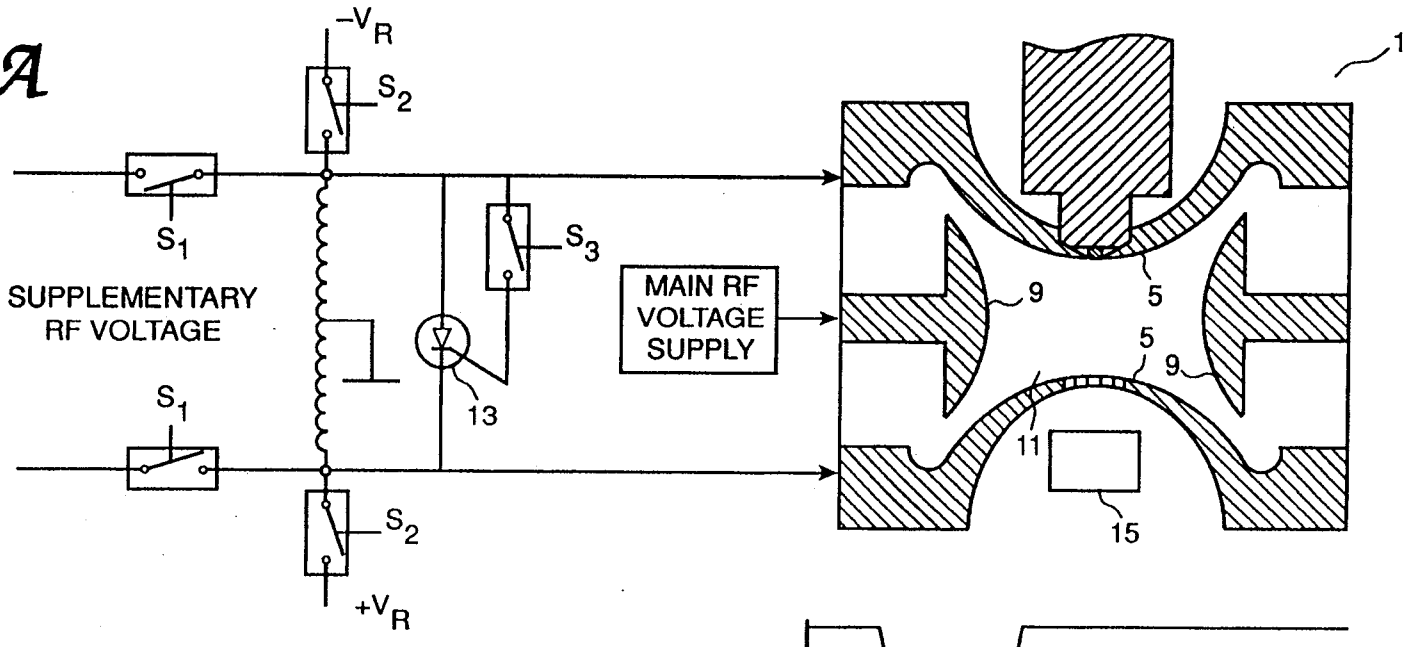
FIG. 10A is a diagram of an embodiment of the present invention having a DC voltage applied to the end cap electrodes.

In a first embodiment of the present invention, a voltage such as an RF voltage or the like having a gradually increasing (ramping) amplitude as shown in FIG. 8C is applied to the ring electrode 9 as shown, for example, in FIG. 10A when the ions are being introduced into the ion trap 1. The RF voltage is applied beginning at zero amplitude and is ramped up to an amplitude of about 12 kV. The amplitude of the RF voltage increases (ramps) as a function of the capacitance, inductance and resistance of the gating circuit (not shown) of the main RF voltage supply shown in FIG. 10B. Hence, the rate of increase of the amplitude of the RF voltage can be approximately linear. Essentially, an overall gradual voltage increase over time that avoids an instantaneous voltage increase is within the scope of the present invention.

Preferably, the amplitude of the RF voltage being applied to the ring electrode 9 gradually increases as the ions travel into the center of the ion trap cavity 11, thus providing very high ion trapping efficiency and eliminating the need for phase synchronization shown in FIG. 9B. Furthermore, this gradually increasing voltage enables higher mass resolution to be achieved at normal mass scanning speeds without the presence of high pressure buffer gas in the ion trap cavity 11.

The first embodiment can be used with various arrangements for decreasing the initial kinetic energy of ions being introduced in the trap as described below.

Figure 10B:
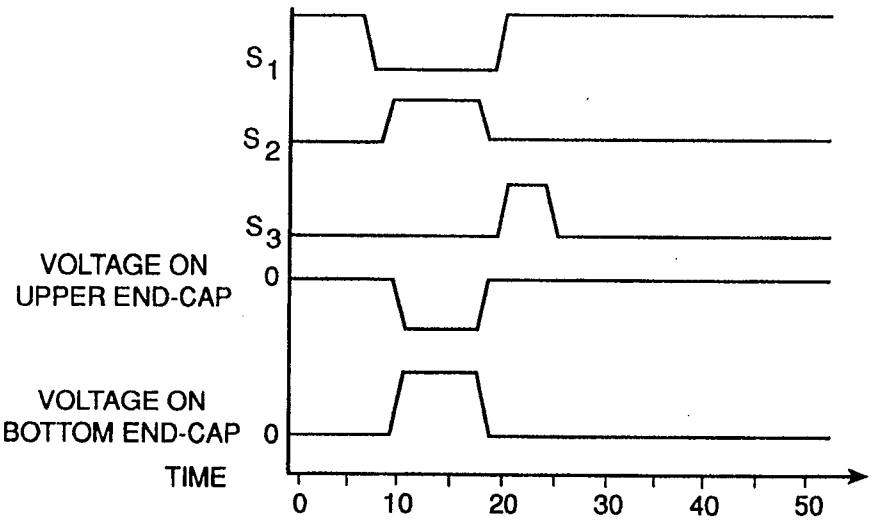
FIG. 10B is a timing chart of the switches in FIG. 10A.

As shown in a second embodiment of the invention illustrated in FIGS. 10A and 10B, just prior to ramping the amplitude of the RF voltage being applied to the ring electrode as in the first embodiment, a voltage Vr is applied across the end-cap electrode 5 through which the probe tip 3 is inserted. That is, prior to introducing ions into the ion trap cavity 11, switches ($S_1$) are opened, to disconnect the supplementary RF voltage generator from the end-cap electrodes 5, and switches ($S_2$) are closed to couple the DC voltage source Vr to the end-cap electrodes 5. Voltage Vr, when applied to the end-cap electrodes, provides a relatively low, static electrical field for reducing the initial kinetic energy of ions entering the ion trap cavity 11. Voltage Vr can be up to approximately 100 V.

The laser (see FIG. 9A) is fired near (immediately before or after) the time switches $S_2$ are closed. After a predetermined period of time, such as approximately 5 microseconds in this embodiment, switches $S_1$ and $S_2$ are reversed (i.e. switches S1 are closed and switches S2 are opened) and analog switch ($S_3$) is closed to enable thyristor 13 to damp the electromagnetic oscillations caused by switching, and to supply a supplementary RF voltage or the like to the end-cap electrodes 5. During these switching operations, the amplitude of the RF voltage being applied to the ring electrode 9 is ramped (i.e., gradually increased—see FIG. 8C) to trap the ions in the ion trap cavity 11.

Figure 11:
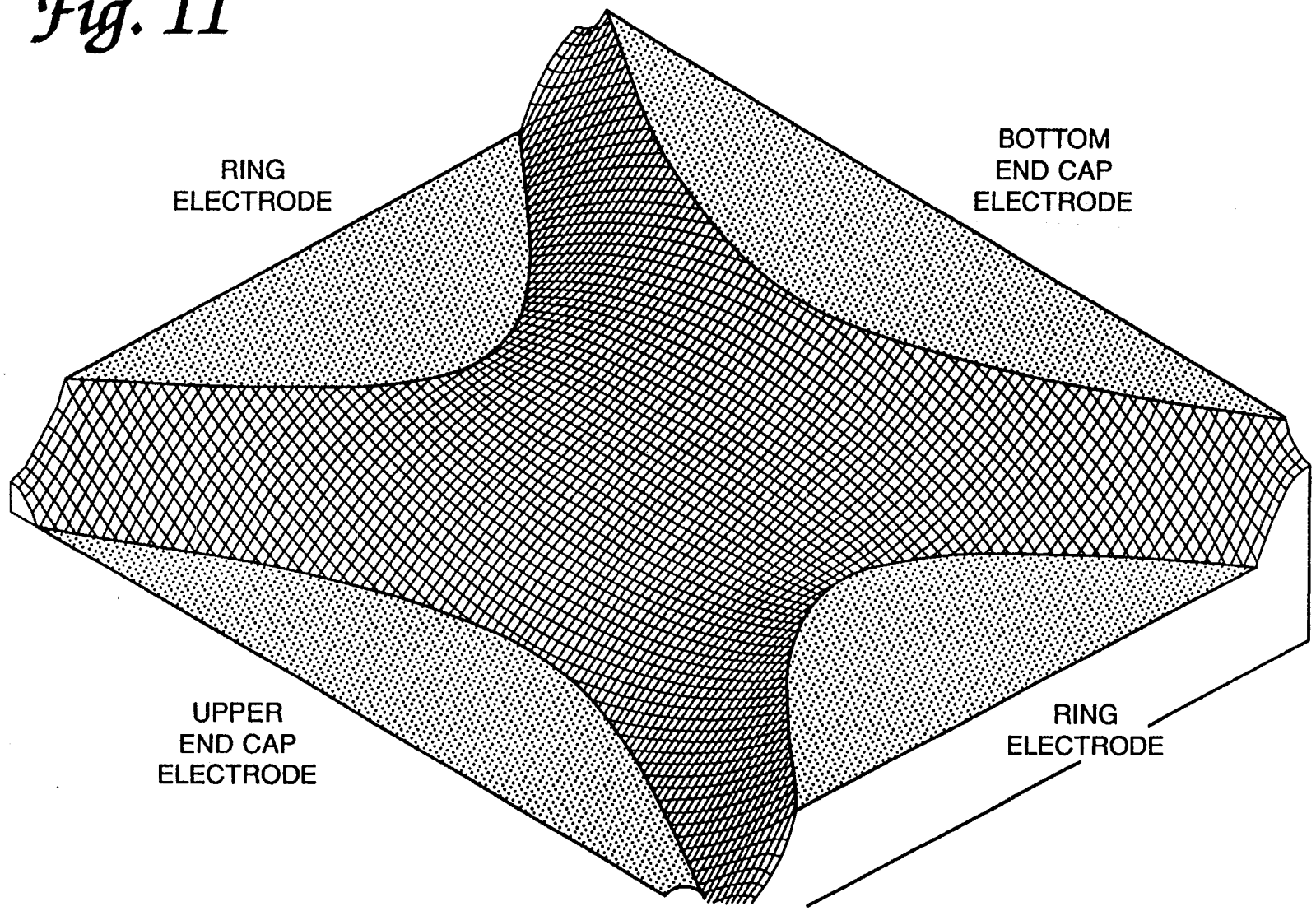
FIG. 11 is a SIMION program illustration of a potential voltage distribution in an embodiment of the ion trap of present invention as shown in FIGS. 10A–B.

FIG. 11 illustrates a voltage field distribution inside the ion trap cavity 11, obtained using a SIMION (simulated ion trajectory calculation) program, when zero voltage is applied to the ring electrode 9, and −9 and +9 volts (i.e., Vr=18 V) are applied to the top and bottom end-cap electrodes 5, respectively. As shown, a gradual increase in potential from the upper to bottom end-cap electrode 5 is exhibited.

Figure 12:
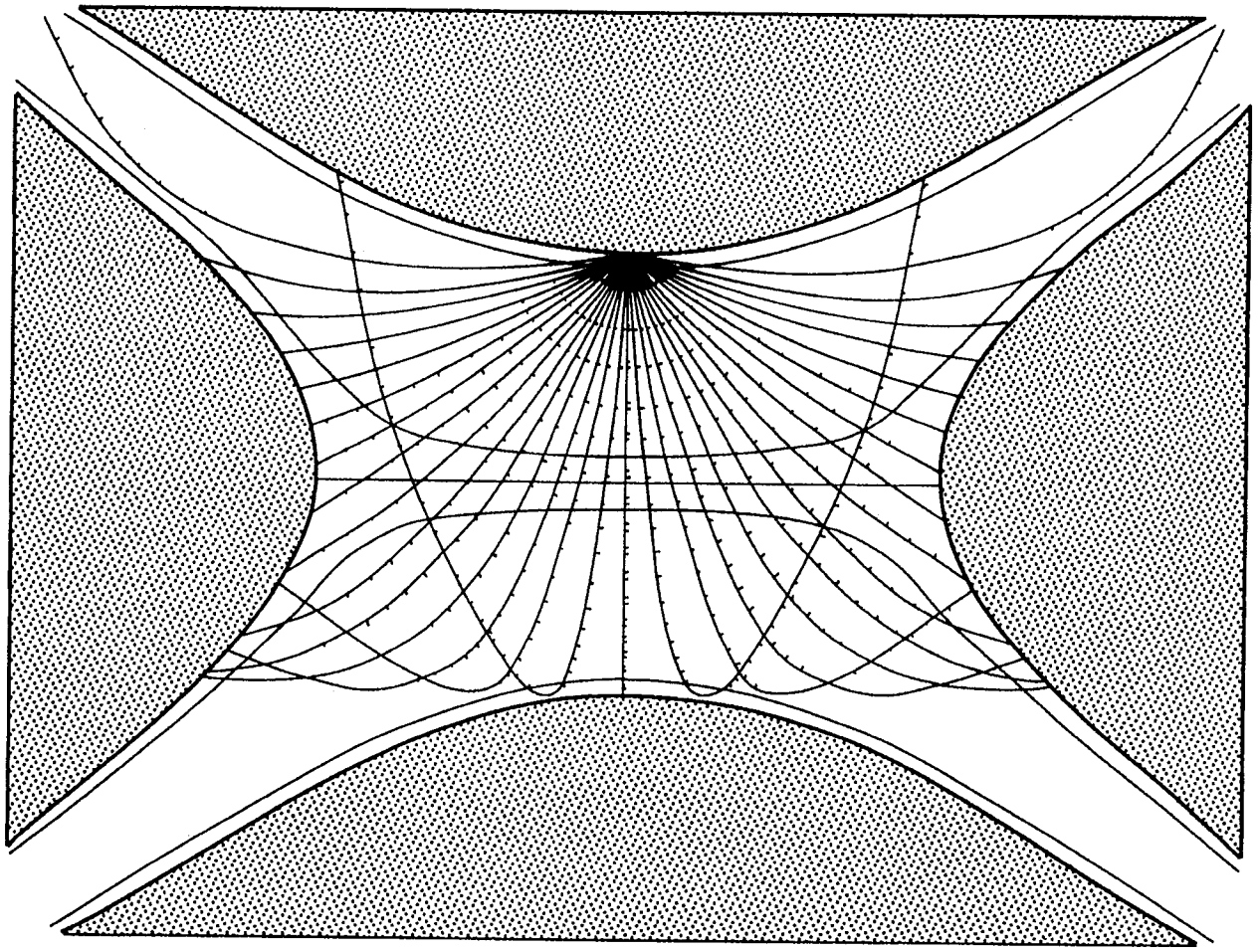
FIG. 12 is a potential ion trajectory representation based on the voltage distribution illustrated in FIG. 11.

The ion trajectories predicted for the voltage field distribution simulated in FIG. 11 are simulated in FIG. 12 for ions having a mass/charge ration m/z=1860, initial kinetic energies of 18 Ev, and trajectory angles from −80° to 80° (relative to the normal axis) in 5° increments. Markers on the trajectory lines correspond to ion positions in time, plotted in 1 μs intervals, to indicate the velocity of the ions. Thus, FIG. 12 illustrates that it takes from approximately 5 to 8 μs for the ions to reach the central part of ion trap cavity 11.

Although this second embodiment achieves the objects of the present invention, a defocusing effect of the electric field occurs, which results in poor concentration of ions in the center of the cell. This problem is eliminated by a second embodiment of the present invention shown in FIG. 13 and described below.

In a third embodiment of the invention, switch $S_4$ is closed to apply a retarding voltage Vr to the probe tip 3 which is electrically isolated from the end cap electrodes 5, in particular, from the upper end-cap electrode 5 through which it is inserted. Prior to introducing ions into the ion trap cavity 11 through desorption or the like, the ring electrode 9 and end-cap electrodes 5 are set at zero voltage while a voltage Vr of −18 V is applied to the probe tip 3. Voltage Vr, when applied to the probe tip 3, provides a relatively low, static electrical field for reducing the initial kinetic energy of ions entering the ion trap cavity 11.

Similar to the first and second embodiments, the laser (see FIG. 8) is fired near (immediately before or after) the time Vr is applied to the probe tip 3. After a predetermined period of time, switch $S_4$ is opened to uncouple voltage Vr from the probe tip 3 and switches $S_5$ are closed to supply a supplementary RF voltage to the end-cap electrodes 5. As in the second embodiment, when switches $S_5$ are closed, analog switch (S3) is closed to enable thyristor 13 to damp the electromagnetic oscillations caused by switching. Also, as in the second embodiment, during these switching operations, the amplitude of the RF voltage being applied to the ring electrode 9 is ramped (i.e., gradually increased—see FIG. 8C) to trap the ions in the ion trap cavity 11.

Figure 14:
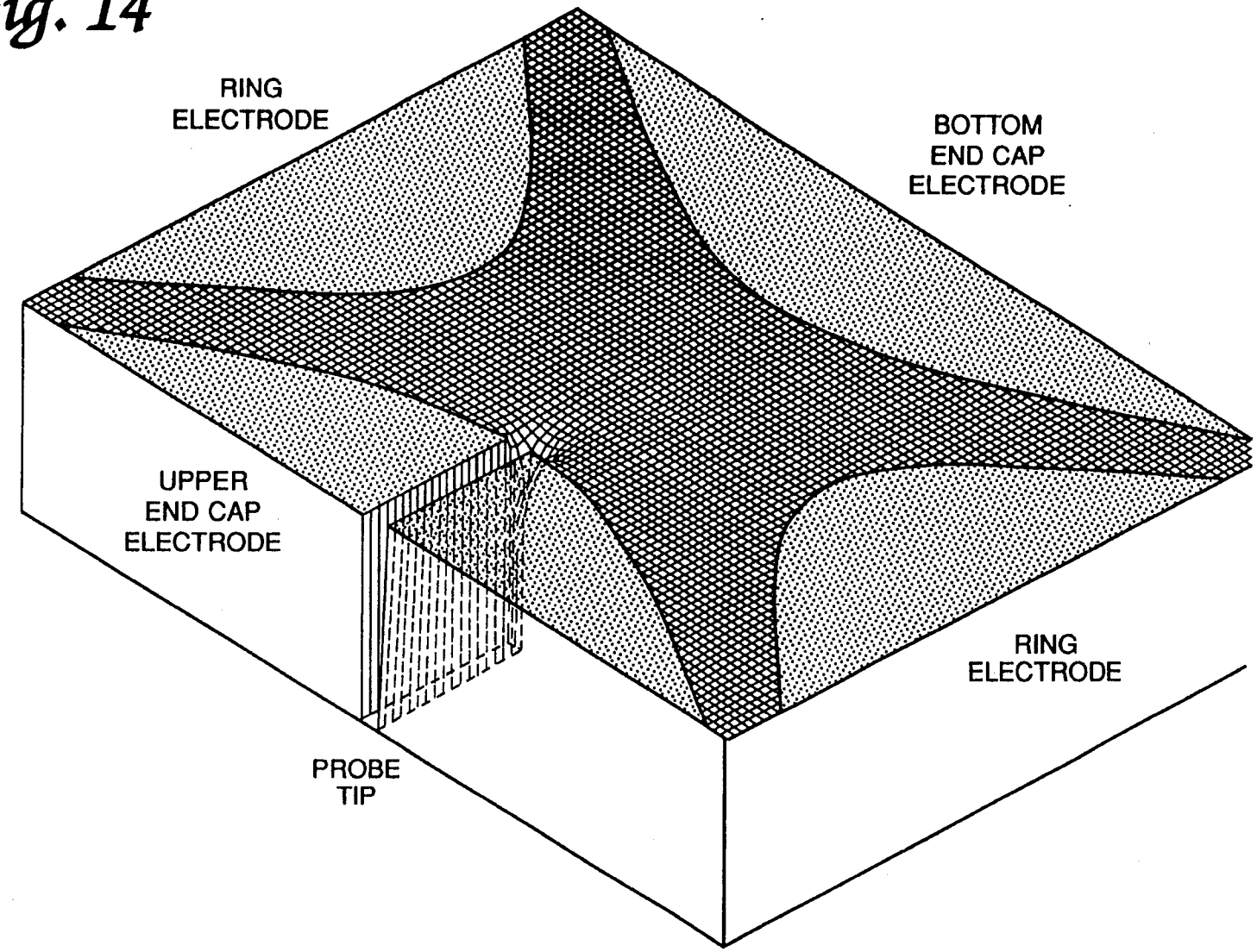
FIG. 14 is a SIMION program illustration of a potential voltage distribution in the second embodiment of the ion trap of present invention.
Figure 15:
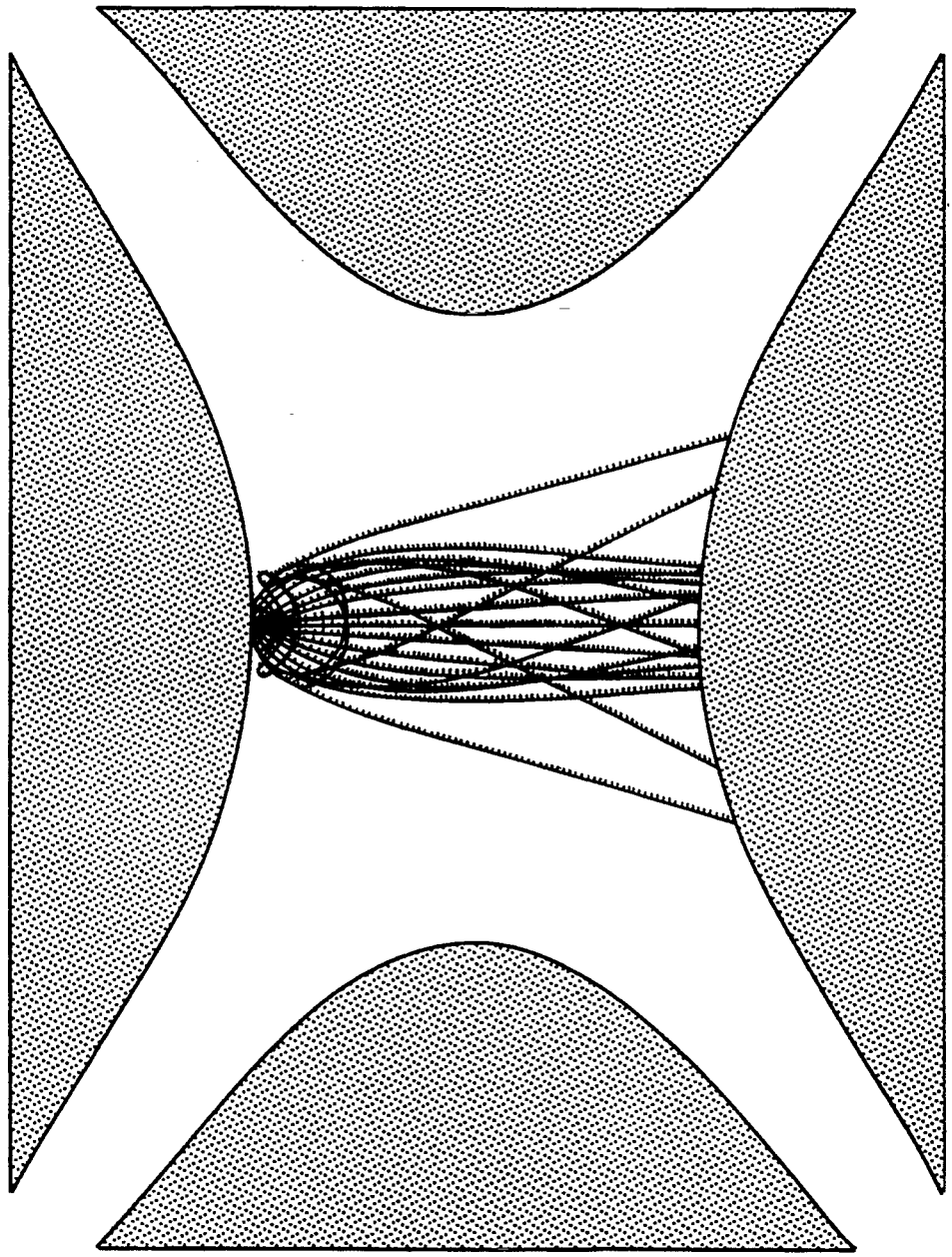
FIG. 15 is a potential ion trajectory representation based on the voltage distribution illustrated in FIG. 14.

A voltage field distribution inside the ion trap cavity 11 for this embodiment, as calculated using the SIMION program, is shown in FIG. 14. The voltage field distribution inside the trap is disturbed only in the vicinity (e.g. within approximately 1 mm) of the central part of upper end-cap electrode 5 where the probe tip 3 is inserted. Simulated ion trajectories for this embodiment, as shown in the FIG. 15, indicate that most of the ion trajectories pass through the center of ion trap cavity 11.

An additional advantage provided by the second embodiment is that the ions being introduced into the ion trap cavity 11 lose kinetic energy more quickly. Also, the retarding voltage Vr is applied for only a few microseconds to retard the ions within the perturbed region (it takes approximately 2 μs for ions to escape this region), but less than the time for the ions to then drift through the ion trap cavity 11 (usually more than 10 μs). At this point, the RF electric field created by ring electrode 9 is increased gradually, reaching a value sufficient to trap the ions as they approach the center of the ion trap.

As in the second embodiment, the supplementary RF voltage applied to the end cap electrodes 5 can be adjusted to cause ions of a particular molecular weight, trapped in the ion trap cavity 11 by the ion trapping field generated by the RF voltage being applied to the ring electrode 9, to oscillate and exit the ion trapping cavity 11. That is, as the supplementary RF voltage is varied, ions of varying molecular weights trapped in the ion trapping field are expelled from the ion trapping field.

Figure 13:
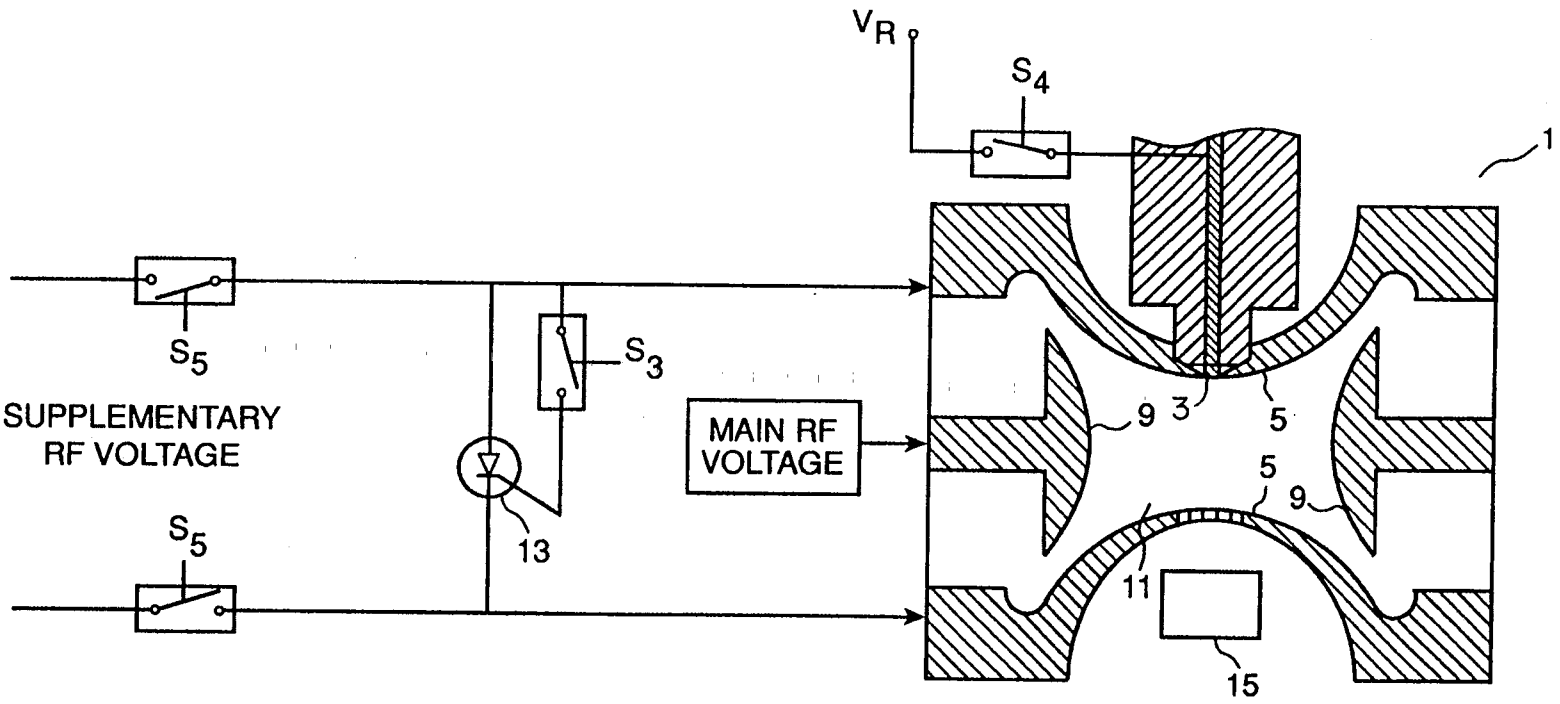
FIG. 13 is a diagram of an embodiment of the present invention having a DC voltage applied to the probe.

The ions exiting the ion trapping field can exit the ion trap cavity 11, for example, through a small opening in one of the end cap electrodes 5. A detector 15 such as a electron multiplier detector or the like as shown in FIGS. 10A and 13 detects the ions exiting the apparatus and outputs signals from which parameters of the ions can be determined.

Figure 16:
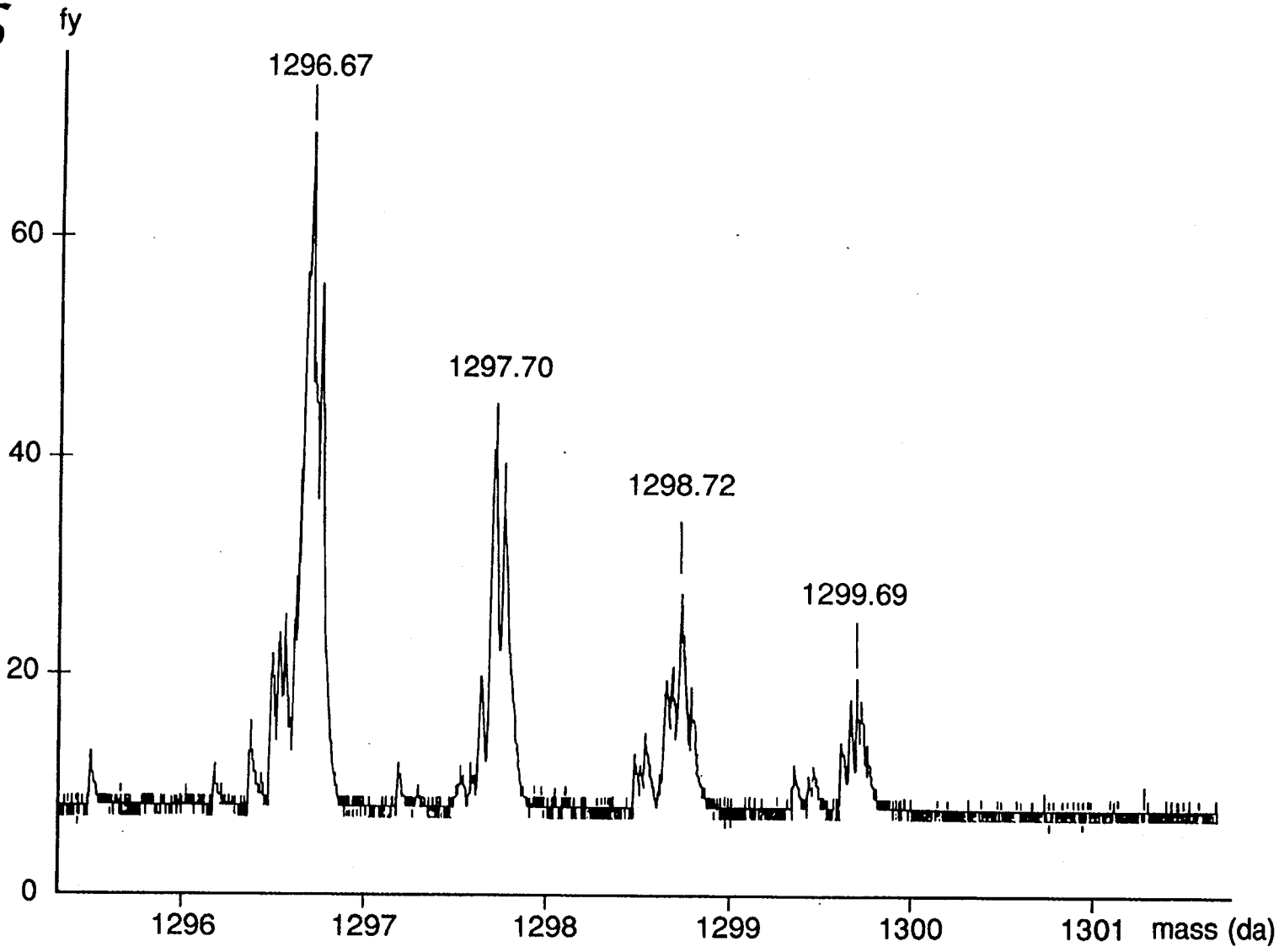
FIG. 16 is a graphical illustration of a molecular ion region mass spectrum of Angiotensin I obtained by the present invention.

The molecular ion region mass spectrum of Angiotensin I (molecular weight 1296 Da) is shown in FIG. 16 and was determined using an apparatus according to the first embodiment. A single laser shot was used to obtain these results at a pressure (approximately 1 mtorr) typical for normal trap operation and several times less than that used in previous MALDI experiments.

The frequency of the supplementary excitation voltage on the end-cap electrodes was 172.1 Khz, and no retarding electric field was required. The low pressure and slow scan rates (approximately 2.15 ms/Da or approximately 12 times slower than the standard ITD scan rate) produced high mass resolution (approximately one part in 12,000). Such high mass resolutions have not been previously observed in MALDI experiments in the quadruple ion trap.

The ion trap 1 can be used to detect ions having masses within a 50–100 kDa range, for example, when a Vr of about 100 V is applied to the end-cap electrodes and the amplitude of the RF voltage is ramped to 12 kV. For lower Vr voltages, such as 18 V in the second embodiment, the 12 kV RF voltage can be used to detect ions having masses up to the 2–3 kDa range.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. A method for trapping ions in an ion trapping field of an ion trapping device having a ring electrode and at least one end cap electrode, comprising the steps of:

introducing ions into said ion trapping field, each of said ions having an initial kinetic energy; and applying an alternating voltage, having a first amplitude, to said ring electrode and increasing, at a predetermined gradual rate, said first amplitude to a second amplitude during a period of time when said ions are being introduced into said ion trapping field to trap said ions in said ion trapping field.

2. A method as claimed in claim 1, further comprising a step of applying a voltage to said at least one end cap electrode to reduce said initial kinetic energy of said each of said ions being introduced into said ion trapping field.

3. A method as claimed in claim 1, wherein said predetermined gradual rate is substantially linear.

4. An apparatus as claimed in claim 1, wherein said introducing step comprises the steps of:

introducing a substance into an area in which said ion trapping field will exist and bounded by said ring electrode and said at least one end cap electrode; and directing a light beam onto said substance to create said ions.

5. A method as claimed in claim 1, wherein said introducing step introduces said ions into said ion trapping field from an external source.

6. A method as claimed in claim 2, further comprising the step of removing said voltage from said at least one end cap electrode when said alternating voltage causes said ions to be trapped in said ion trapping field.

7. A method as claimed in claim 1, wherein said introducing step further comprises the steps of:

inserting a probe having a substance thereon into said ion trapping device; and forming said ions from said substance to cause said ions to be introduced into an area in which said ion trapping field will exist and bounded by said ring electrode and said at least one end cap electrode.

8. A method as claimed in claim 7, further comprising the step of applying a first voltage to said probe to reduce said initial kinetic energy of said each of said ions being introduced into said ion trapping field.

9. A method as claimed in claim 8, further comprising a step of applying a second voltage, different from said first voltage, to said at least one end cap electrode when said first voltage is being applied to said probe.

10. A method as claimed in claim 7, wherein said predetermined gradual rate is substantially linear.

11. A method as claimed in claim 7, wherein said forming step comprises the step of directing a light beam onto said substance to create said ions.

12. A method as claimed in claim 8, further comprising the steps of:

removing said first voltage from said probe when said alternating voltage causes said ions to be trapped in said ion trapping field; and applying a second voltage to said at least one end cap electrode after said first voltage is removed from said probe.

13. An apparatus for trapping ions, comprising:

a ring electrode;

at least one end cap electrode;

means for introducing ions into an ion trapping field, each of said ions having an initial kinetic energy; and means for applying an alternating voltage, having a first amplitude, to said ring electrode to create said ion trapping field and increasing, at a predetermined gradual rate, said first amplitude to a second amplitude during a period of time when said ions are being introduced into said ion trapping field to trap said ions in said ion trapping field.

14. An apparatus as claimed in claim 13, further comprising means for applying a voltage to said at least one end cap electrode to reduce said initial kinetic energy of said each of said ions being introduced into said ion trapping field.

15. A method as claimed in claim 13, wherein said predetermined gradual rate is substantially linear.

16. An apparatus as claimed in claim 13, wherein said introducing means comprises:

means for introducing a substance into an area in which said ion trapping field will exist and bounded by said ring electrode and said at least one end cap electrode; and means for directing a light beam onto said substance to create said ions.

17. An apparatus as claimed in claim 13, wherein said introducing means comprises means for introducing said ions into said ion trapping field from an external source.

18. An apparatus as claimed in claim 14, further comprising means for removing said voltage from said at least one end cap electrode when said alternating voltage causes said ions to be trapped in said ion trapping field.

19. An apparatus as claimed in claim 13, wherein said ion introducing means comprises:

substance introducing means for introducing a substance into an area in which said ion trapping field will exist and bounded by said ring electrode and said at least one end cap electrode; and means for causing said ion introducing means to introduce said ions into said ion trapping field from said substance.

20. An apparatus as claimed in claim 19, wherein said predetermined gradual rate is linear.

21. An apparatus as claimed in claim 19, further comprising means for applying a first voltage to said substance introducing means to reduce said initial kinetic energy of said each of said ions introduced by said ion introducing means.

22. An apparatus as claimed in claim 21, further comprising means for applying a second voltage, different from said first voltage, to said at least one end cap electrode when said first voltage applying means applies said first voltage to said substance introducing means.

23. An apparatus as claimed in claim 19, wherein said ion introducing means comprises means for directing a light beam onto said substance to create said ions.

24. An apparatus as claimed in claim 21, further comprising:

means for removing said first voltage from said substance introducing means when said alternating voltage causes said ions to be trapped in said ion trapping field; and means for applying a second voltage to said at least one end cap electrode after said removing means removes said first voltage from said ion introducing means.

25. A method according to claim 1 wherein said introducing step directs ions created at a non-centered portion of said ion trapping field toward a center portion of said ion trapping field.

26. A method as claimed in claim 25, further comprising a step of applying a voltage to said at least one end cap electrode to reduce said initial kinetic energy of said each of said ions being introduced into said ion trapping field.

27. A method as claimed in claim 25, wherein said predetermined gradual rate is substantially linear.

28. A method as claimed in claim 26, wherein said predetermined gradual rate is substantially linear.

29. A method as claimed in claim 26, further comprising the step of removing said voltage from said at least one end cap electrode when said alternating voltage causes said ions to be trapped in said ion trapping field.

30. An apparatus as claimed in claim 13 wherein said means for introducing directs ions created at a non-centered portion of said ion trapping field toward a center portion of said ion trapping field.

31. An apparatus as claimed in claim 30, further comprising means for applying a voltage to said at least one end cap electrode to reduce said initial kinetic energy of said each of said ions being introduced into said ion trapping field.

32. A method as claimed in claim 30, wherein said predetermined gradual rate is substantially linear.

33. A method as claimed in claim 31, wherein said predetermined gradual rate is substantially linear.

34. An apparatus as claimed in claim 31, further comprising means for removing said voltage from said at least one end cap electrode when said alternating voltage causes said ions to be trapped in said ion trapping field.

* * * * *